United States Patent [19]

Longsworth

[11] Patent Number: 4,484,458

[45] Date of Patent: Nov. 27, 1984

[54] APPARATUS FOR CONDENSING LIQUID CRYOGEN BOIL-OFF

[75] Inventor: Ralph C. Longsworth, Allentown, Pa.

[73] Assignee: Air Products and Chemicals, Inc., Allentown, Pa.

[21] Appl. No.: 550,323

[22] Filed: Nov. 9, 1983

[51] Int. Cl.[3] ..... F25B 19/00

[52] U.S. Cl. ..... 62/514 JT; 62/6

[58] Field of Search ..... 62/514 R, 514 JT, 6

[56] References Cited

U.S. PATENT DOCUMENTS

| | | | |
|---|---|---|---|
| 3,148,512 | 9/1964 | Hoffman et al. | 62/6 |
| 3,299,646 | 1/1967 | Stuart et al. | 62/40 |
| 3,620,029 | 11/1971 | Longsworth | 62/6 |
| 3,942,010 | 3/1976 | Peterson et al. | 62/514 JT |
| 4,223,540 | 9/1980 | Longsworth | 62/514 |
| 4,279,127 | 7/1981 | Longsworth | 62/77 |

*Primary Examiner*—Ronald C. Capossela

*Attorney, Agent, or Firm*—James C. Simmons; E. Eugene Innis

[57] ABSTRACT

An apparatus for condensing cryogen (e.g., helium) boil-off in a confined space such as the neck tube of a helium cryostat comprising a Joule-Thompson heat exchanger and valve disposed around a displacer-expander cryogenic refrigerator so the thermal gradient in the heat exchanger matches that of the refrigerator.

8 Claims, 2 Drawing Figures

APPARATUS FOR CONDENSING LIQUID CRYOGEN BOIL-OFF

BACKGROUND OF THE INVENTION

This invention pertains to refrigerators of the displacer-expander type used in conjunction with a Joule-Thompson heat exchanger terminating in a Joule-Thompson valve to produce refrigeration at 4.0 to 4.5° Kelvin (K).

BACKGROUND OF THE PRIOR ART

The use of a displacer-expander refrigerator in conjunction with a Joule-Thompson heat exchanger for condensing liquid cryogen (e.g. helium) boil-off is disclosed in U.S. Pat. No. 4,279,127 and U.S. Pat. No. 4,223,540. Patentee in both of the aforementioned patents was attempting to recondense helium boil-off in a vacuum jacketed reservoir used to cool an electronic device to achieve super conductivity. As the device is used, heat is generated and the inventory of liquid cryogen begins to boil off. In order to conserve the liquid cryogen, a refrigerator is disposed in the access ports, or in one access port, to cool heat shields and to condense the cryogen boil-off.

As described in U.S. Pat. No. 4,223,540, the refrigerator should match the temperature gradient in the access port to minimize heat transfer losses. This is similar in concept to the helium liquefier-cryostat described in the U.S. Pat. Nos. 3,360,955 and 3,299,646. Heat transfer losses are relatively high for both of these refrigerators, because the Joule-Thompson heat exchanger is separate from the expander: thus, the cryostat has a large cross-sectional area. U.S. Pat. No. 3,148,512, FIG. 8, shows a two stage displacer type expander with a Joule-Thompson heat exchanger of the finned tube-in-shell type mounted concentrically on the outside of the expander and in close thermal relation to the expander regenerator. This design incurs heat transfer losses due to the mis-match of temperature gradients between the regenerator and the Joule-Thompson heat exchanger and the temperature recycling of the regenerator.

SUMMARY OF THE INVENTION

In order to minimize the size of the access port to an inventory of liquid cryogen in a liquid cryogen cryostat, any refrigerator or cooling device disposed therein, must of necessity be of small diameter. In order to provide refrigeration at 4.0° to 4.5° K. to condense boil-off of liquid helium, it has been discovered that a dual circuit heat exchanger of the parallel passage type can be wound around a displacer-expander refrigerator such as disclosed in U.S. Pat. No. 3,620,029 with the Joule-Thompson valve spaced apart from the coldest stage of the refrigerator in order to produce refrigeration at 4.0° to 4.5° K. at the Joule-Thompson valve and in an associated helium condenser, refrigeration at 15° to 20° K. at the second stage of the displacer-expander refrigerator, and refrigeration at 50° to 77° K. at the first stage of the displacer-expander refrigerator. When the refrigerator is mounted in the neck tube of a dewar the gas in the neck tube can transfer heat from the expander to the heat exchanger (or visa versa) and from the neck tube to the heat exchanger, (or visa versa). By helically disposing the parallel passage heat exchanger around the refrigerator, the temperature gradient in the heat exchanger can approximate the temperature gradient in the displacer-expander type refrigerator and in the stratified helium between the coldest stage of the refrigeration and in the helium condenser, thus minimizing heat loss in the cryostat when the refrigerator is in use.

DETAILED DESCRIPTION OF THE PREFERRED EMBODIMENT

Figure 1:
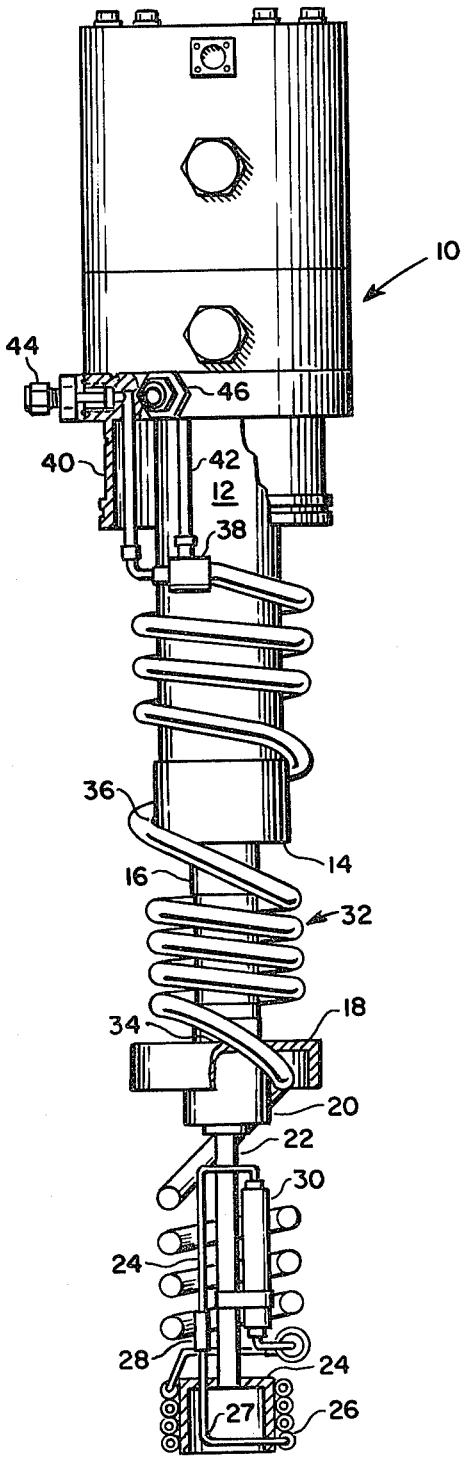
FIG. 1 is a front elevational view of the apparatus of the present invention.

Referring to FIG. 1, there is shown a displacer-expander refrigerator 10, the details of which are disclosed in U.S. Pat. No. 3,620,029, the specification of which is incorporated herein by reference. Refrigerators of this type are sold by Air Products and Chemical, Inc., Allentown, Pa. as Model DE202. Refrigerator 10 includes a first or warm stage 12, capable of producing refrigeration at heat station 14 at temperatures of between 50° to 77° K. and a second or cold stage 16, capable of producing refrigeration at temperatures of 15° to 20° K. at heat station 20.

Refrigerator 10 includes an adaptor 18 having high thermal conductivity mounted on heat station 20 which provides a means of transferring heat from a heat shield in the dewar to the refrigerator 10. Adaptor 18, in turn, contains an extension conduit 22 which supports and terminates in a helium recondenser 24. Helium recondenser 24 is a length of finned heat exchanger tube 26 which communicates with a Joule-Thompson valve 28 through conduit 27. Joule-Thompson valve 28, in turn, via conduit 29 is connected to an adsorber 30, the function of which is to trap residual contaminants such as neon.

Figure 2:
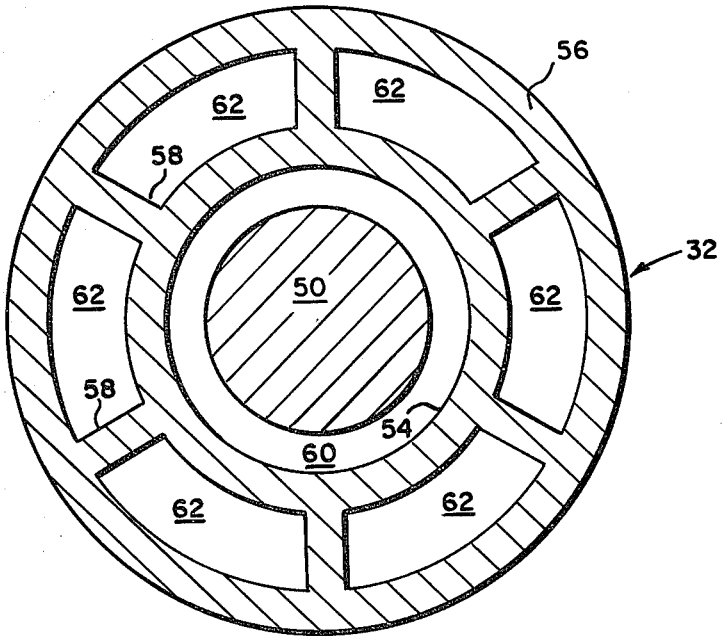
FIG. 2 is an enlarged cross-sectional view of parallel passage heat exchanger tubing usable with the present invention.

Adsorber 30 is, in turn, connected to the high pressure supply side of a parallel passage heat exchanger 32 which is helically wound around the refrigerator 10 with intimate mechanical contacts 34 and 36 at the second stage 20 and first stage 14 heat stations respectively. The heat exchanger 32 continues upwardly terminating in a manifold or header 38 which in turn is connected to an inlet conduit 40 and an outlet conduit 42 with suitable fluid tight fittings 44 and 46. Heat exchanger 32 is of the parallel passage type such as shown in the enlarged cross-section of FIG. 2. Heat exchanger 32 includes a central mandrel 50 disposed in axial relationship to an inner wall 54 which in turn is disposed from an outer wall 56 by a plurality of webs 58. The arrangement of the heat exchanger thus permits the inner passage 60 defined by mandrel 50 and inner wall 54 to be used as a high pressure supply passage (path) and the passages 62 between the inner wall 54 and the outer wall 56 to be used as return passages (paths) for low pressure gas.

In operation, refrigerator 10 can be placed in the neck tube of a dewar used to hold liquid helium. The refrigerator itself operates by cooling a working fluid such as helium to produce the refrigeration at the first and second heat stations at 50° to 77° K. and 15° to 20° K. respectively. The heat exchanger 32 is connected to a source of high pressure fluid by fitting 44, and fitting 46 is connected to a receptacle to receive low pressure fluid which may include a compressor for recompressing the fluid for re-use. The size of the heat exchanger 32 is selected so that the heat transfer losses are small compared with the refrigeration produced by the displacer-expander refrigerator 10. The high pressure gas exiting the Joule-Thompson valve becomes liquid which then circulates through heat exchanger 26 to recondense any helium boil-off in the dewar. The temperature at the helium recondenser will usually be between 4.0° and 4.5° K.

The heat exchanger 32 can be soldered directly to the refrigerator heat stations and the refrigerator heat stations bolted to the refrigerator 10 to make for easy assembly and disassembly for cleaning and servicing.

A device, according to the present invention, was constructed and operated with the following results:

| | Heat Station* | | |
|---|---|---|---|
| | 1 | 2 | 3 |
| Temperature (°K.) | 49 | 15.9 | 3.9 |
| Expander Capacity (Watts) | 3.5 | 1.6 | — |
| Heat Exchanger and Parasitic Losses (Watts) | 4.6 | 1.1 | 0.1 |
| Net Available Refrigeration (Watts) | 0 | 0 | 0.3 |

*1 Warm Stage Heat Station (14)
2 Cold Stage Heat Station (20)
3 Helium Recondenser (24)

It is understood that this invention can be practiced by:

(a) the use of an expander producing refrigeration at three or more stages; or (b) operating at temperatures somewhat outside the normal ranges listed; or (c) refrigerators having more or less refrigeration capacity than those listed; or (d) other heat exchanger geometries which may be coiled around the expander (refrigerator) in such a way as to match the temperature gradients of the expander (refrigerator) and cryostat neck tube (e.g. stratified helium between the coldest stage of the refrigerator and the associated helium condenser).

Having thus described my invention, what is desired to be secured by Letters Patent of the United States is set forth in the following claims.

I claim:

1. An apparatus for condensing liquid cryogen boil-off in a confined space comprising in combination:

a multi-stage displacer-expander refrigerator with each stage of said refrigerator containing a heat station, said refrigerator having a coldest stage capable of being cooled to between 15° and 20° K.;

a helium recondenser disposed axially and spaced apart from the coldest stage of said refrigerator;

a Joule-Thompson heat exchanger coiled around said refrigerator and in thermal contact with each of said heat stations, said heat exchanger constructed and arranged to conduct high pressure helium to a Joule-Thompson valve disposed upstream of said helium recondenser and return low pressure helium, said Joule-Thompson heat exchanger adapted to approximately match thermal gradients in said refrigerator and in the stratified helium between the coldest stage of said refrigerator and said helium condenser.

2. An apparatus according to claim 1 wherein said Joule-Thompson heat exchanger consists of a high pressure cryogen tube disposed within a larger diameter, low pressure multi channel cryogen tube.

3. An apparatus according to claim 1 wherein the heat exchanger is a tube within a tube.

4. An apparatus according to claim 1 wherein there is included an adsorber upstream of said Joule-Thompson valve.

5. An apparatus according to claim 1 wherein said heat exchanger includes at least one continuous low pressure return path from the vicinity of the helium condenser normally at 4.2° Kelvin to a location on the apparatus at ambient temperature.

6. An apparatus according to claim 1 wherein said heat exchanger includes at least one continuous high pressure path from the vicinity of the helium condenser normally at 4.2° Kelvin to a location on the apparatus at ambient temperature.

7. An apparatus according to claim 1 wherein said heat exchanger is removably fastened to said refrigerator.

8. An apparatus according to claim 1 wherein said helium recondenser includes a finned tube heat exchanger.

* * * * *